United States Patent [19]

Dohrendorf

[11] 4,430,845

[45] Feb. 14, 1984

[54] FOLDER FOR POLYFILM

[75] Inventor: Hans A. Dohrendorf, Menomonie, Wis.

[73] Assignee: Doboy Packaging Machinery Inc., New Richmond, Wis.

[21] Appl. No.: 220,260

[22] Filed: Dec. 24, 1980

[51] Int. Cl.[3] ..... B65B 9/06

[52] U.S. Cl. ..... 53/550; 493/302; 493/440

[58] Field of Search ..... 53/550, 220, 562, 568, 53/372, 551; 493/248, 302, 440, 439, 438

[56] References Cited

U.S. PATENT DOCUMENTS

| | | | |
|---|---|---|---|
| 516,186 | 3/1894 | Crowell | 53/550 X |
| 3,303,630 | 2/1967 | Harm | 53/550 X |
| 3,420,035 | 1/1969 | Deans et al. | 53/550 |
| 3,426,499 | 2/1969 | Paige | 53/551 X |
| 3,532,516 | 10/1970 | Erekson | 53/550 X |
| 3,653,177 | 4/1972 | Adams et al. | 53/550 |
| 3,664,088 | 5/1972 | Sherman | 53/551 X |
| 3,732,789 | 5/1973 | Hartleib | 53/562 X |
| 4,084,999 | 4/1978 | Rucker | 53/551 X |
| 4,216,638 | 8/1980 | Yoshida | 53/550 X |

FOREIGN PATENT DOCUMENTS

| | | | |
|---|---|---|---|
| 928606 | 6/1963 | United Kingdom | 53/550 |

*Primary Examiner*—Horace M. Culver

*Attorney, Agent, or Firm*—Orrin M. Haugen; Thomas J. Nikolai

[57] ABSTRACT

A packing machine having a film former for converting a flat, unfolded web of thermoplastic film material into a relatively flat rectangular tube with one major surface of the flat tube having an inwardly turned edge and the other major surface of the flat tube overlapping the turned-in edge. In one embodiment, the former itself comprises a single piece of rigid sheet material which has a generally rectangular portion with an isosceles right triangle integrally formed thereon, the two legs of that triangle being aligned, respectively, with an end edge and an adjacent side edge of the rectangular piece. The sheet material is then folded over or otherwise formed such that the end edge and its extension, i.e., one leg of the isosceles triangle, are parallel to the adjacent side edge with the plane of the folded portion being generally parallel to the plane of the rectangular portion. The film former has a further notch formed inwardly from the adjacent edge and disposed in the notch is a further folded triangular segment. As the web of film is routed over and through the former, the flat rectangular tube described above is generated on a continuous basis and the product being packaged is simultaneously fed through the former and into the flat tube as it is generated. A side seal is then created in the overlapping area and, subsequently, transversely extending end seals are formed to totally encapsulate the product while severing the web.

2 Claims, 4 Drawing Figures

FOLDER FOR POLYFILM

BACKGROUND OF THE INVENTION

I. Field of the Invention

This invention relates generally to automatic packaging machinery, and more specifically to the design of a film former used therein which may be used to create a wrapper for brochures, flyers and similar literature, the wrapper being specifically constructed so as to present a pleasing, uninterrupted pattern over the major surfaces of the wrapper.

II. Discussion of the Prior Art

A wide variety of packaging and bag making machines which utilize polyethylene or other suitable thermoplastic film materials are known in the art. However, until the present invention, none has been able to adequately and efficaciously handle paper products such as those encountered in the bulk mailing industry. In this application, stacks of individual sheets are deposited by a collator onto an infeed conveyor leading to the wrapping machine. The infeed conveyor includes suitable pushers for maintaining a predetermined spacing between individual stacks to be wrapped. Because of the nature of the product, it must be handled on a continuous rather than intermittent basis and, furthermore, it is required that the stack of literature or documents be supplied in a straight-line to the wrapping station. Where either intermittent stepping of the machine or directional changes are encountered, the inertia tends to cause the individual documents to be splayed out making the wrapping operation significantly more difficult.

It is also oftentimes desirable to provide decorative artwork or graphics on one or both side surfaces of the flat package. Thus, a seal line down the center of the package cannot be used if unsightly discontinuities in the graphics are to be avoided. Then too, when doing wrappings for bulk mailing, it is common that the wrapper have a small transparent "window" in the graphics through which addressing labels on the material packaged therein is visible. This dictates that the literature materials being wrapped be sufficiently constrained from moving within the package so as to have the addressing information no longer aligned with the window.

In the Shanklin et al U.S. Pat. No. 4,219,988 there is described a wrapping machine for wrapping packages in heat sealable thermoplastic film. The supply roll of film is prefolded longitudinally and at an inverting head the film is made to surround the product to be packaged prior to being moved through a side sealer where the loose edges are joined to form a tube. This type of sealing requires that the selvage at the sealed edge be trimmed off and disposed of. Finally, the tube with the packages therein appropriately is spaced and fed into an end sealer which serves to create a seal in a zone between adjacent packages while simultaneously severing the tube transversely to form individual sealed packages.

Machines like those described in the Shanklin et al U.S. Pat. No. 4,219,988 tend to have serious drawbacks. Specifically, the handling of the selvage has proven to be a significant problem in high speed packaging machines of the type described. The edge scrap cut loose tends to become electrostatically charged and is therefore difficult to handle. Attempts at winding the selvage onto a reel have not been altogether successful in that the machine must be periodically shut down for reel replacement, thus limiting the output production of the machine. Furthermore, when the edge seal is formed in such a fashion that the cutting loose of the selvage occurs simultaneously at the site of the seal, it is sometimes difficult to maintain the integrity of the seal. Thus, when the wrapped package of loose individual sheets is handled, there is a considerable likelihood that the seal will rupture and that the sheets comprising the contents may fall out the imperfectly sealed side edge.

The packaging machine of the present invention obviates all of the foregoing deficiencies of known prior art machines for wrapping sheet goods such as packs of printed literature and the like. These results are achieved principally by the incorporation of a unique film former which is disposed in the path of the film and in general, straight-line relationship to the infeed conveyor supplying the sheet goods to be packaged. The former which is utilized is operative to produce a generally flat rectangular tube around the stack of sheet goods fed into the former by the infeed conveyor. The tube is such that one major surface has a predetermined edge border turned inward and the remaining major surface of the rectangular tube overlaps that border. Upon exit from the film former, the tube containing the product is fed to a side sealer which is positioned to create a continuous longitudinal seal a predetermined distance inward from the extreme edge of the package in the zone where the second major surface overlaps the turned-in border portion of the first major surface. Following the side sealing step, the package is fed through an end sealer which creates a fusion bond transversely to the side seal and at locations which are spaced in accordance with the spacing maintained between individual packs of printed literature to be packaged arriving from the infeed conveyor. This end sealing operation also severs the package loose from the rest. Because of the manner in which the film material is turned inward at the edge or border of the first major surface, following end sealing, the package is sufficiently tacked together so that the sheets comprising the product cannot fall out of the package even if the side seal should be faulty.

In that the side seal line is not at the extreme edge of the package, it is less likely that such a side seal will rupture which is not the case in prior art arrangements. Then too, the film former of the present invention obviates the need for trimming the package following the side sealing step. Therefore, there is no selvage to deal with. Because no edge trimming is required the integrity of the graphics is maintained, adding to the aesthetic appearance of the resulting package.

Furthermore, by providing a degree of adjustability to the film former, the overall width of the flat tubular package can be accurately controlled so that any address information which may be printed on materials contained within the package can be made to line up with a transparent window zone.

SUMMARY OF THE INVENTION

The foregoing improvements over the prior art are achieved by incorporating into the packaging machine a film former which is able to convert a flat, unfolded web of thermoplastic film material into a generally flat tube. In one embodiment, the film former comprises a single piece of rigid sheet material which is generally rectangular, but which has an isosceles right triangle integrally formed therewith. The legs of the isosceles right triangle are aligned respectively with an end edge and an adjacent side edge of the rectangular piece. The sheet metal is then folded over such that the end edge of the rectangle and its extension, i.e., one leg of the isosceles right triangle, are parallel to the adjacent side edge. In addition, the film former has a notch formed inwardly from that adjacent edge and disposed in the notch is a much smaller folded triangular segment. The spacing between that smaller folded triangular segment and the intersection of the hypotenuse of the much larger isosceles right triangle with the adjacent edge of the rectangular piece is controlled in that that dimension determines the overall width of the resulting package. As the web of unfolded film is routed over and through the film former, the flat rectangular tube is generated on a continuous basis. Simultaneously, the product being packaged is fed endwise into the film former and therefore into the flat tube as it is generated.

In an alternative arrangement, the distance between the smaller triangular segment and the aforementioned intersection of the hypotenuse of the larger isosceles right triangle with the adjacent edge is adjustable, within limits, to accommodate products of varying widths.

OBJECTS

It is accordingly a principal object of the present invention to provide an improved packaging machine for packaging stacks of loose sheet material.

Another object of the invention is to provide a packaging machine having a novel film former for converting unfolded sheets of thermoplastic film into a flat tube of rectangular cross-section having an overlap between one major surface thereof and a turned-in edge of the second major surface.

Still another object of the invention, related closely to the immediately foregoing object, is to provide a packaging machine in which sheet products may be wrapped in a way which allows decorative graphics to be incorporated on the film wrapper itself without objectionable seal lines running through the graphics and without a need to trim the package following a sealing operation.

These and other objects and advantages of the invention will become apparent to those skilled in the art from the following detailed of a preferred embodiment when considered in conjunction with the accompanying drawings in which like numerals in the several views refer to corresponding parts.

DESCRIPTION OF THE PREFERRED EMBODIMENT

Figure 1:
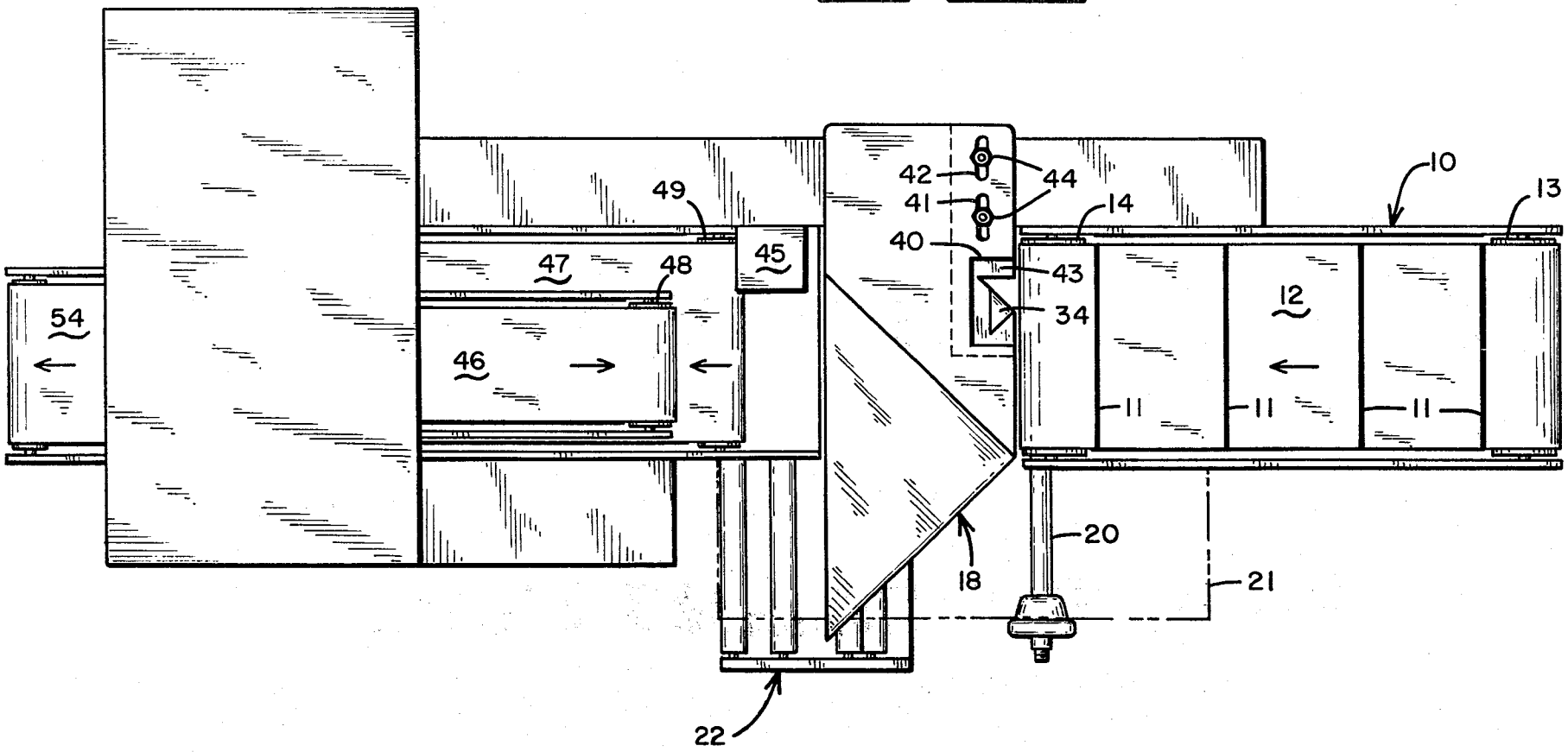
FIG. 1 is a top view of a packaging machine incorporating the improved film former.

Before describing the constructional details of the invention, certain terminology will be defined. This terminology will be used in the following description for convenience in reference only and should not be considered as limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof, and words of similar import.

Figure 2:
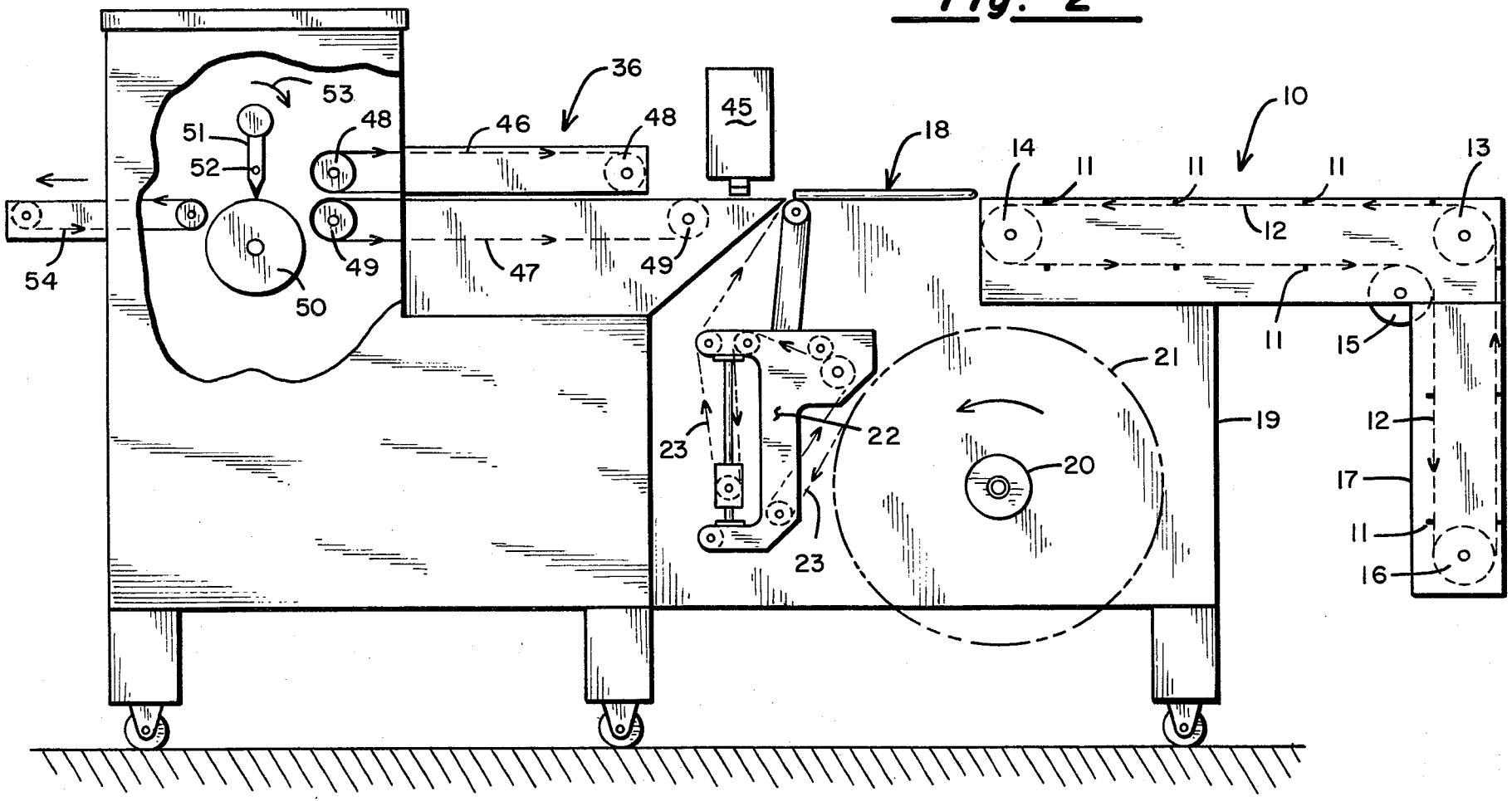
FIG. 2 is a side elevation of the machine of FIG. 1.

With reference, then, to FIGS. 1 and 2, the packaging machine in which the present invention finds use may include an infeed conveyor indicated generally by numeral 10 which is adapted to receive, on a continuous basis, the product to be packaged. In that the present invention is intended chiefly, but not exclusively, for wrapping printed matter in the form of, say, $8\frac{1}{2}'' \times 11''$ loose pages or the like, such product may be stacked in a collator (not shown) and stacks deposited between pusher elements 11 so as to be moved in unison from the collator to the film forming station. The pusher elements are mounted on an endless belt 12 which is synchronously driven by a source of motor power associated with other elements of the machine yet to be described. The endless belt is played over guide rollers 13 and 14 and an idler roller 15. A further guide roller 16 which is maintained under tension in a slack loop box 17 provides a convenient means for compensating for any transient changes in the velocity of the moving belt 12.

The discharge end of the infeed conveyor 10 abuts a film forming station, indicated generally by numeral 18, which is secured to the upper horizontal portion of the frame 19 of the machine. Mounted on the frame 19 is also a film roll spindle 20 which is arranged to receive in flat, unfolded form, a roll 21 containing a continuous web of thermoplastic film material of a predetermined width and thickness. Typically, the thermoplastic film may be $1\frac{1}{2}$ mil polyethylene; however, limitation to that material and thickness is not to be inferred. The width of the web is determined by the width and thickness of the package to be wrapped. The film is presented to the film former 18 by way of a roll dancer mechanism 22 which serves to maintain proper tension in the film web as it is carried through the packaging machine. This tensioning device 22 is altogether conventional and it is believed unnecessary to explain its construction in detail. The routing of the film over the various rollers and the like comprising the roll dancer 22 is illustrated in the view of FIG. 2 and the web itself is identified by numeral 23.

Before proceeding with the manner in which the film web 23 is routed through the former, consideration will be given to the constructional features of the film former 18 itself and, in this regard, its shape configuration will be set forth with the aid of the developed diagram of FIG. 3.

With reference to this diagram, then, it can be seen that the film former in its unfolded form comprises a generally rectangular sheet having a left end edge 24, a right end edge 25, an upper side edge 26 and a lower side edge 27 which is parallel to the edge 26. Rather than being wholly rectangular, the film former member includes an integrally connected isosceles right triangular portion indicated by numeral 28 having a first leg 29 which is an extension of the right end edge 25 of the rectangle. The triangular portion 28 is integrally joined to the adjacent edge 26 of the rectangle along a further leg 30 which is indicated by a ghostline. The hypotenuse of the triangle portion 28 is indicated by numeral 31.

In use, the rigid sheet material from which the former is fabricated is folded along the dashed line 32 so that the larger isosceles triangle, defined by the lines 25, 29, 31 and 32, overlays the generally rectangular portion of the former. This arrangement can best be seen in the plan view of FIG. 1. The former is preferably fabricated from stainless steel; however other materials such as molded plastic may be used.

Figure 3:
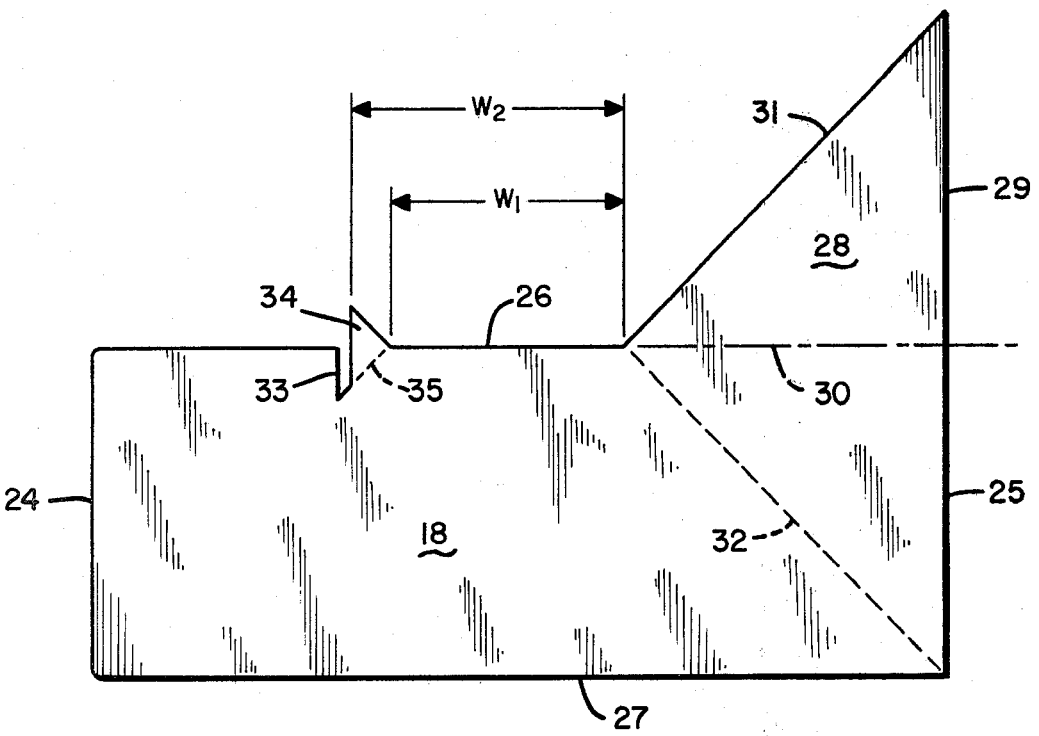
FIG. 3 is a plan view of the film former before it is folded into the configuration illustrated in the top view of FIG. 1.

With continued reference to FIG. 3, it can be seen that the former further includes a notch having the shape of an isosceles right triangle which extends inwardly from the side edge 26 of the former, one leg 33 of the triangular notch being generally parallel to the end edges 24 and 25 and the other leg of the triangular notch being along the edge 26 of the rectangular portion. Integrally formed with and extending from the hypotenuse of the triangle just described is a small triangular projection 34, also having the shape of an isosceles right triangle. As can best be seen in the view of FIG. 1, the triangular projection 34 is folded along the dashed line 35 so that the projection 34 lies in a plane which is above and generally parallel to the plane of the rectangular portion.

Now that the constructional features of one embodiment of the film former have been set forth, consideration will be given to the manner in which the flat film web 23 is routed through it and the way that it is arranged relative to the infeed conveyor so that the product to be wrapped will be enveloped by the film.

As is indicated in FIG. 2, the film web 23 approaches the film former 18 from the bottom. Next, with reference to FIG. 1, the film web is routed over the sloping edge defined by the fold line 32 in FIG. 3 and the film is then folded so as to next ride over the edge defined by the hypotenuse 31 of the larger triangular segment and from there, between the under surface of the larger triangular segment and the upper surface of the otherwise rectangular portion over which the triangular segment is folded, the film being drawn by a drive conveyor indicated generally by the numeral 36. Thus, the flow of film is reversed in direction 180° in passing through the former. The result of the passage of the film over the former, as thus far explained, creates a longitudinally folded film with generally equal "halves". At the same time, the outer edge of the bottom half of the film web is routed over the folded edge 35 of the smaller folded triangular projection 34, through the triangular notch and then back under the folded triangular projection 34 between it and the upper surface of the otherwise rectangular portion of the film former. As the film is drawn from the supply reel 21 and through the fomer in the manner indicated so as to flow to the left when viewed in the top plan view of FIG. 1, a generally flat tube having a rectangular cross-section results. Specifically, and with reference to FIG. 4, the tube has a first major surface 37 which is turned inward at one edge border 38 by the action of the smaller triangular projection 34 and a second major surface 39 thereof overlaps the inwardly turned portion 38, as indicated.

Figure 4:
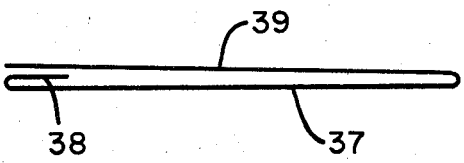
FIG. 4 illustrates the cross-section of the flat tubular package produced by film passing through the film former.

As the film is being formed into the flat rectangular tube having the cross-section as indicated in FIG. 4, it is simultaneously receiving the product from the infeed conveyor 10. As can best be seen in FIG. 1, the product to be packaged enters the film former in the location between the intersection of the hypotenuse 31 with the leading edge 26 and the intersection of the fold line 35 with the same edge 26. Thus, the former made in accordance with FIG. 3 is capable of accepting a product having a width dimension, $W_1$, and will wrap it in an envelope having a width, $W_2$. The acceptable thickness for the package flowing through the former is determined by the vertical spacing maintained between the generally rectangular flat plate portion of the former and the overlying triangular portions.

To achieve a measure of adjustability in the overall width of the package, the film former may be constructed in the manner best illustrated in FIG. 1. Specifically, rather than forming the small triangular notch defined by lines 33 and 35 in FIG. 3 directly in the edge 26 of the rectangular plate portion of the film former, it may be provided instead with an elongated rectangular notch as at 40. Furthermore, one or more elongated slots extending generally parallel to the edges 26 and 27 may be formed through the thickness dimension of the plate as at 41 and 42. Then, a separate and smaller rectangular plate 43 having the aforementioned triangular notch and small triangular projection configuration formed on it is provided. By bolting the plate 43 to the undersurface of the former by bolts 44 and having the triangular projection 34 extending upward through the notch 40, it is possible to adjust the position of the plate 43 laterally in a direction transverse to the normal flow of product through the former. Thus, some flexibility is provided over the dimension $W_1$ illustrated in FIG. 3.

As the formed flat rectangular tube exits the film former 18, the overlapped zone between the border 38 and the upper surface 39 is presented to a side seal assembly 45 which may be arranged to provide a jet of hot air to the tubular package as it passes beneath it. The hot air is sufficient to fuse and thereby bond together the film surface 39 with the underlying border zone 38 along a seal line on a continuous basis.

The drive conveyor 36 may conveniently comprise first and second endless belts 46 and 47 which pass about drive rollers 48-48 and 49-49, respectively, to cause the belts to move in the direction indicated by the arrowheads on these belts. A spacing is maintained between the adjacent flights of the belts 46 and 47, that spacing corresponding to the height dimension of the filled package exiting from the side sealer 45. Thus, the belts 46 and 47 frictionally engage the package and cause it to be pulled through the packaging machine.

Disposed proximate the outlet end of the conveyor assembly 36 is a conventional end sealer arrangement comprising a roller-type anvil 50 and a rotating knife 51. The blade of the knife 51 is arranged to be electrically heated by a suitable resistance heater element 52 passing transversely through it. As is common in packaging machinery of the type involved here, the rotation of the blade 51 in the direction indicated by the arrow 53 is at an angular velocity which is synchronized with that of the infeed conveyor 10 and the passage of the film 23 through the former 18. As a result, the blade 51 is made to contact the flat tubular package on a repetitive basis at the space maintained between adjacent products as they move through the system. The heated blade 51 not only provides a transverse seal across the width dimension of the package, but also effects a severing of the film whereby individual packaged products exit from the machine's outfeed conveyor 54.

Thus it can be seen that the various objects and advantages mentioned in the introductory portion of this specification are achieved with the preferred embodiment described. That is, means are provided for individually packaging flat sheets of literature like that encountered in bulk mailing applications in thermoplastic film pre-printed with graphics on a continuous basis and at relatively high rates. A unique seal configuration results from the use of a specially designed film former which ensures more reliable side sealing without the need of handling any selvage in that no edge trimming is required.

While the invention has been described herein in considerable detail, in order to comply with the Patent Statutes and to provide those skilled in the art with information needed to apply the novel principles and to construct and use such specialized components as are required, it is to be understood that the invention can be carried out by specifically different equipment and devices, and that various modifications, both as to equipment details and operating procedures can be effected without departing from the scope of the invention itself.

What is claimed is:

1. A machine for wrapping products in heat sealable thermoplastic film, comprising:

(a) an infeed conveyor for moving products at a given spacing to a film forming station;

(b) a film supply for providing an unfolded web of thermoplastic film of a predetermined width to said film forming station;

(c) a generally rectangular sheet of rigid material having an isosceles right triangle integrally formed therewith, one leg of said isosceles right triangle being an extension of one side edge of said rectangular sheet and the other leg of said isosceles right triangle being integrally joined to the edge of said rectangular sheet adjacent to said one side edge, said rectangular sheet being folded diagonally from the point of intersection of the hypotenuse of said right triangle with said adjacent edge and the intersection of said one side edge and the edge of said rectangular sheet parallel to said adjacent edge of said rectangular sheet;

(d) said rectangular sheet having a notch in the form of an isosceles right triangle, one leg of said triangular notch extending inwardly from said adjacent edge of said rectangle a predetermined spaced distance from said intersection of said hypotenuse with said adjacent edge;

(e) a triangular projection folded parallel to the surface of said rectangular sheet and integrally joined along one edge to the hypotenuse of said right triangular notch for converting said unfolded web of thermoplastic film into a continuous folded web defining a generally flat tube enveloping the products exiting from said infeed conveyor with one major surface of said flat tube having one side edge thereof folded inwardly towards the products and the edge of the other major surface of said flat tube overlapping said inwardly folded portion of said one surface;

(f) side sealing means; and (g) means for moving said flat tube exiting from said film forming means past said side sealing means such that a substantially continuous seal is formed between said inwardly folded portion of said one major surface and the overlapping portion of said other major surface.

2. A machine for wrapping products in heat sealable thermoplastic film, comprising:

(a) an infeed conveyor for moving products at a given spacing to a film forming station;

(b) a film supply for providing an unfolded web of thermoplastic film of a predetermined width to said forming station;

(c) film forming means located at said forming station for forming said film into a generally flat tube enveloping the products exiting from said infeed conveyor into said forming means, said film forming means comprising a generally rectangular sheet of rigid material having an isosceles right triangle integrally formed therewith, one leg of said isosceles right triangle being an extension of one side edge of said rectangular sheet and the other leg of said isosceles right triangle being integrally joined to the edge of said rectangular sheet adjacent to said one side edge, said rectangular sheet being folded diagonally from the point of intersection of the hypotenuse of said right triangle with said adjacent edge and the intersection of said one side edge and the edge of said rectangular sheet parallel to said adjacent edge of said rectangular sheet, a generally rectangular notch of a predetermined length and width dimension formed inwardly from said adjacent edge of said rectangular sheet at a location displaced from said intersection of said hypotenuse with said adjacent edge, a further generally rectangular sheet of rigid material having a notch in the form of an isosceles right triangle, one leg of said triangular notch extending inwardly from one edge of said further sheet, a triangular projection folded parallel to the surface of said further sheet and integrally joined along one leg to the hypotenuse of said right triangular notch, and means for adjustably attaching said further sheet to said rectangular sheet with said triangular projection extending through said generally rectangular notch, the engagement of said unfolded web of film with the diagonal fold in said rectangular sheet folding said film such that one side edge thereof extends in a first direction and the engagement of said film web with said triangular projection folds the other edge of said web in a direction opposite to said first direction;

(d) side sealing means; and (e) means for moving the flat tube exiting from said film forming means past said side sealing means such that a substantially continuous seal is formed between said one folded side edge portion and the other folded side edge portion.

* * * * *